US008130505B2

(12) United States Patent
Schurz

(10) Patent No.: US 8,130,505 B2
(45) Date of Patent: Mar. 6, 2012

(54) CAR FAN CONTROLLER

(76) Inventor: James Hsu Schurz, Anaheim, CA (US)

( * ) Notice: Subject to any disclaimer, the term of this patent is extended or adjusted under 35 U.S.C. 154(b) by 361 days.

(21) Appl. No.: 12/580,536

(22) Filed: Oct. 16, 2009

(65) Prior Publication Data

US 2010/0271797 A1 Oct. 28, 2010

(30) Foreign Application Priority Data

Apr. 24, 2009 (CN) ..... 2009 3 0137862
May 15, 2009 (CN) ..... 2009 2 0120219 U

(51) Int. Cl.

| | |
|---|---|
| ***H05K 5/00*** | (2006.01) |
| ***F01P 7/10*** | (2006.01) |
| ***F01P 1/00*** | (2006.01) |
| ***F01P 7/02*** | (2006.01) |
| ***F24F 7/00*** | (2006.01) |

(52) U.S. Cl. ..... 361/752; 123/41.49; 123/41.56; 236/35; 236/49.3

(58) Field of Classification Search ..... 439/76.1, 439/76.2, 949; 361/752; 174/520; 62/186, 62/244; 236/35, 49.3; 318/471; 123/41.11, 123/41.12, 41.48, 41.49, 41.63, 41.64, 41.65, 123/41.66

See application file for complete search history.

(56) References Cited

U.S. PATENT DOCUMENTS

| | | | | |
|---|---|---|---|---|
| 5,408,575 | A * | 4/1995 | Morris | 388/830 |
| 5,449,275 | A * | 9/1995 | Gluszek et al. | 417/14 |
| 5,859,581 | A * | 1/1999 | Morris | 338/50 |
| 6,747,543 | B2 * | 6/2004 | Lim | 338/50 |
| 7,061,197 | B1 * | 6/2006 | Mullet et al. | 318/466 |
| 7,342,800 | B2 * | 3/2008 | Matsuura | 361/759 |
| 7,916,489 | B2 * | 3/2011 | Okuya | 361/752 |
| 2003/0017727 | A1 * | 1/2003 | Seo et al. | 439/76.2 |
| 2004/0129010 | A1 * | 7/2004 | Nakajima | 62/244 |
| 2005/0098641 | A1 * | 5/2005 | Ardelt et al. | 236/49.3 |
| 2006/0021363 | A1 * | 2/2006 | Mizukoshi | 62/129 |

* cited by examiner

*Primary Examiner* — Lisa Lea Edmonds
*Assistant Examiner* — Xanthia C Cunningham
(74) *Attorney, Agent, or Firm* — Clement Cheng

(57) ABSTRACT

This invention patent is a utility type of car fan controller. The controller has a housing and inside the housing is a circuit. The housing has a top cover forming a cavity and flat bottom plate. The circuit has a circuit board and an adjustment device with other electronic components. The circuit board has a socket connector and a wire harness connector. The top cover has socket connector aligned with socket connector opening. The top cover also has a wire harness connector aligned to wire harness connector socket. The modular practical new type of invention design facilitates faster assembly and more convenient flexible use.

16 Claims, 4 Drawing Sheets

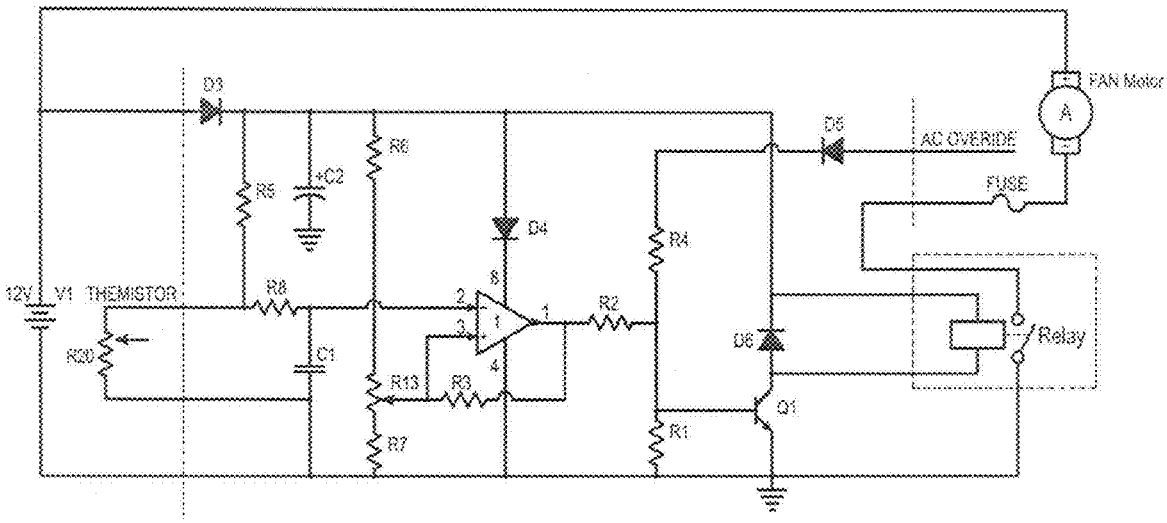
Fig. 4
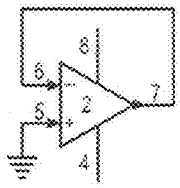

CAR FAN CONTROLLER

This application claims priority from James Hsu Schurz Chinese application 200920120219.X filed May 15, 2009 for Car Fan Controller and James Hsu Schurz Chinese application 2009 30137862.9 filed Apr. 24, 2009 for Car Fan Controller.

TECHNICAL FIELD

The present invention relates to a car fan controller.

BACKGROUND

Older cars did not have a fan controller for changing fan speed. (Radiator Fan Controller, RFC) What was used instead was a fan switch or mechanical control. This proved inadequate and had low efficiency for heat transfer and cooling. It was also difficult to adjust fan speed and amount of cooling. The generated power being low and economically wasteful the old methods were unable to adapt to modern cars. With new RFC, it is now possible to increase the efficiency of the engine cooling system to be more sensitive and reliable.

One example of an electric motor fan control system for vehicle is shown in Yamada U.S. Pat. No. 5,133,302 issued Jul. 28, 1992, which claims foreign priority from Japanese application 2-247990 filed Sep. 18, 1990 both disclosures of which are incorporated herein by reference. Yamada teaches a fan control system of a vehicle for controlling an electric motor fan for cooling a radiator. Cooling fan power management systems were also taught in Claypole U.S. Pat. No. 4,425,766 issued Jan. 17, 1984, the disclosure of which is incorporated herein by reference. Claypole taught a pulse width modulated voltage control device for controlling the voltage applied to the cooling fan motor from the vehicle. Naitoh in U.S. Pat. No. 5,018,484 issued May 28, 1991 shows a variety of temperature sensors for controlling an electric cooling fan of an automotive vehicle, the disclosure of which is incorporated herein by reference. A variety of these fan control systems are known in the art. These fan control circuits can be put on printed circuit board.

But presently, current radiator fan controllers have integrated the main body with the wire harness bonded by cyclooxy resin. The disadvantage is not only cosmetic but the assembly process is old and inefficient. Sealing with resin requires a long time to cure and if testing finds a problem, the entire controller and wire harness is wasted which increases production cost. Also, if during use there is a problem, the user can only replace the entire unit.

SUMMARY OF THE INVENTION

To address the deficiencies of the prior art, the present invention provides a new design with a new production method which is more convenient and more practical which is this RFC. In order to fulfill the above objectives the invention comprises, the controller which includes the housing, the circuit board in the housing, the top cover and the bottom plate. The circuit board has an adjustment device and the circuit board has set connector socket and wire connection board. The top cover has a plug socket opening aligned with the connector socket. This device does not need the resin to secure the electronic components to the housing. This saves time and material to improve production. During testing or replacement in a car, if the electronic components have problem, one can take off the top cover and bottom plate and change only the internal components. This reduces waste and production cost.

The adjustment device has an adjustment device window on the top cover. The top cover has a water resistant elastomeric plug for the adjustment device window which proves easy access to the adjustment device while maintaining water resistance. The device includes the controller and wire harness connecting to a wire harness connector.

The thermocouple can also be modularly replaced and added to the wire harness connector. Additionally, the bottom plate can have mounting surface on both sides with mounting holes. An embodiment of the invention will now be described below by the figures and description.

BRIEF DESCRIPTION OF THE DRAWINGS

FIG. 4 is a circuit diagram of a circuit board.

The following call out list of elements may be helpful in referencing the elements of the drawings.

Housing 1
Circuit 2
Wire Harness 3
Bottom Plate 4
Top Cover 11
Bottom Plate 12
Circuit Board 21
Adjustment Device 22
Socket Connector 23
Wire Harness Connector 24
Wire Harness Plug 31
Connecting Wire 32
Thermocouple 33
Small Plug Connector 34
Mounting Holes 41
Socket Connector Opening 111.
Wire Harness Connector Opening 112
Adjustment Device Window 113
Water Resistant Elastomeric Plug 114
Wire Harness Connector Socket 115

DETAILED DESCRIPTION

Figure 1:
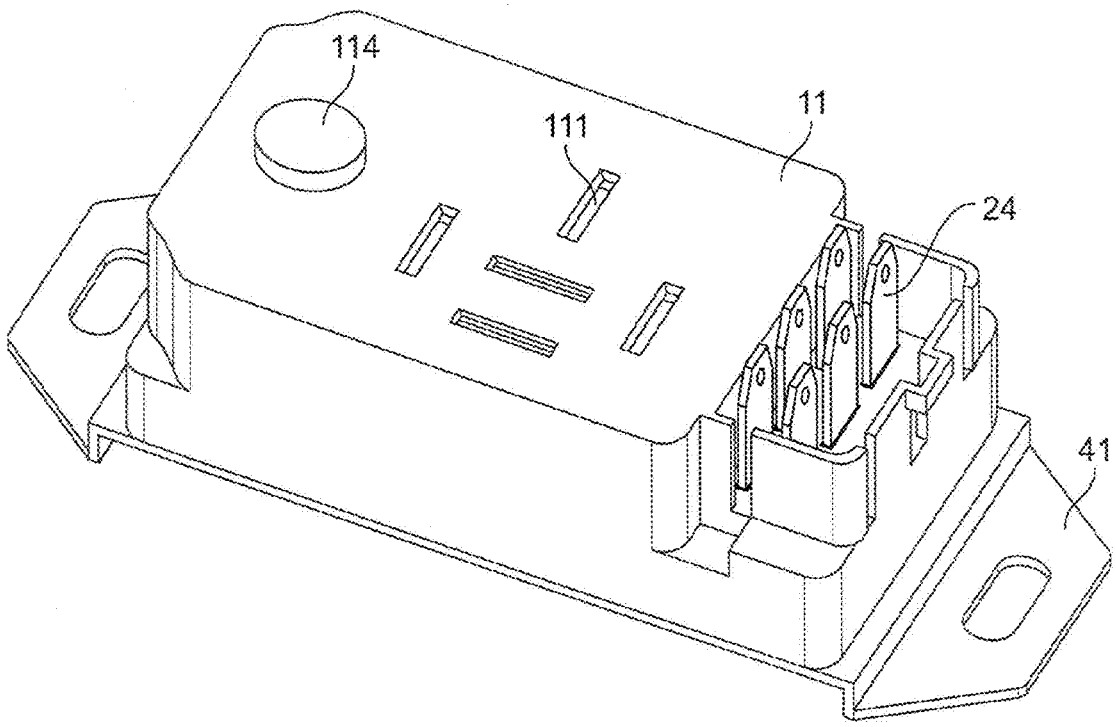
FIG. 1 is a perspective view of the controller unit.
Figure 2:
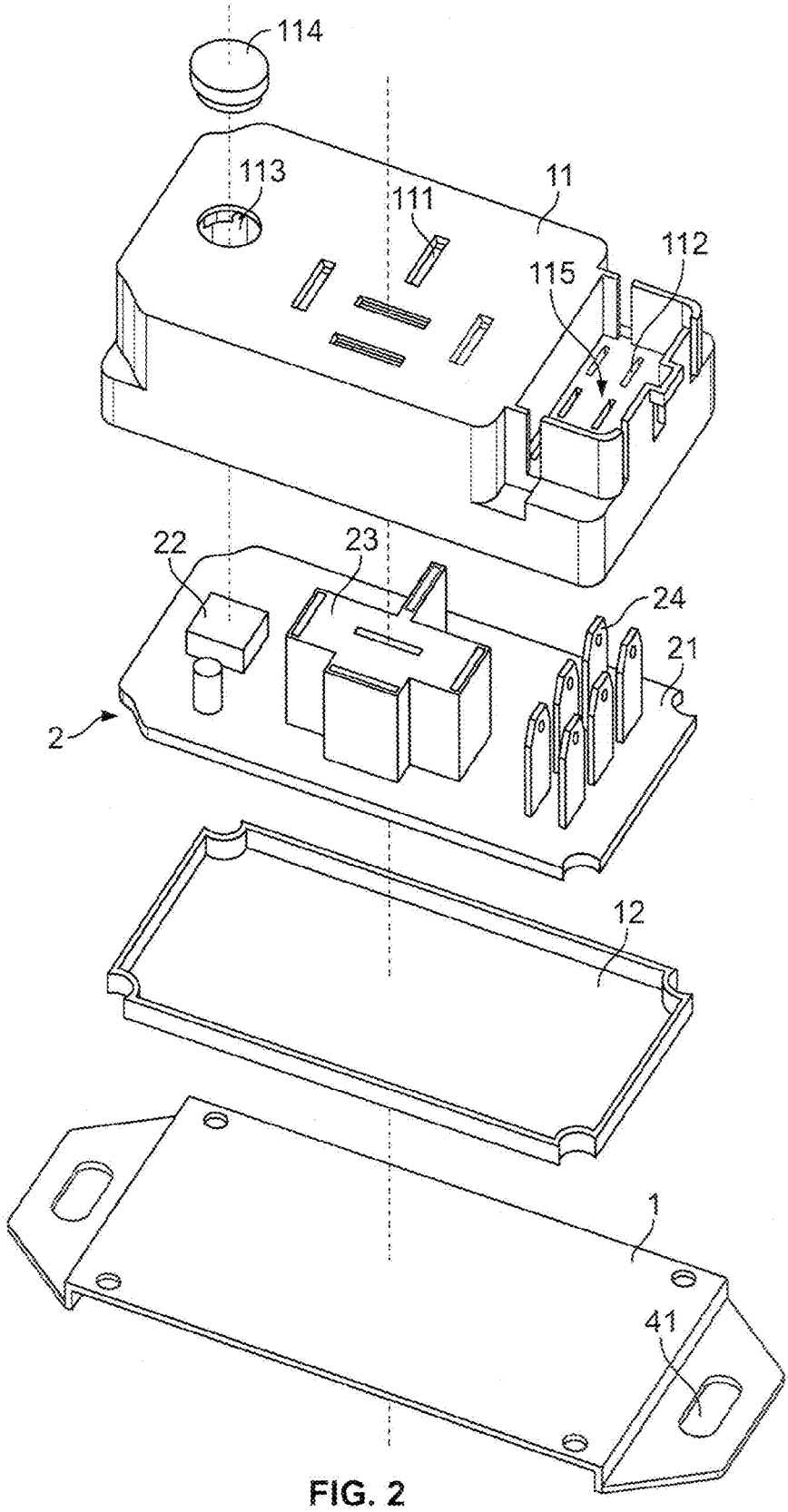
FIG. 2 is a diagram of the component.
Figure 3:
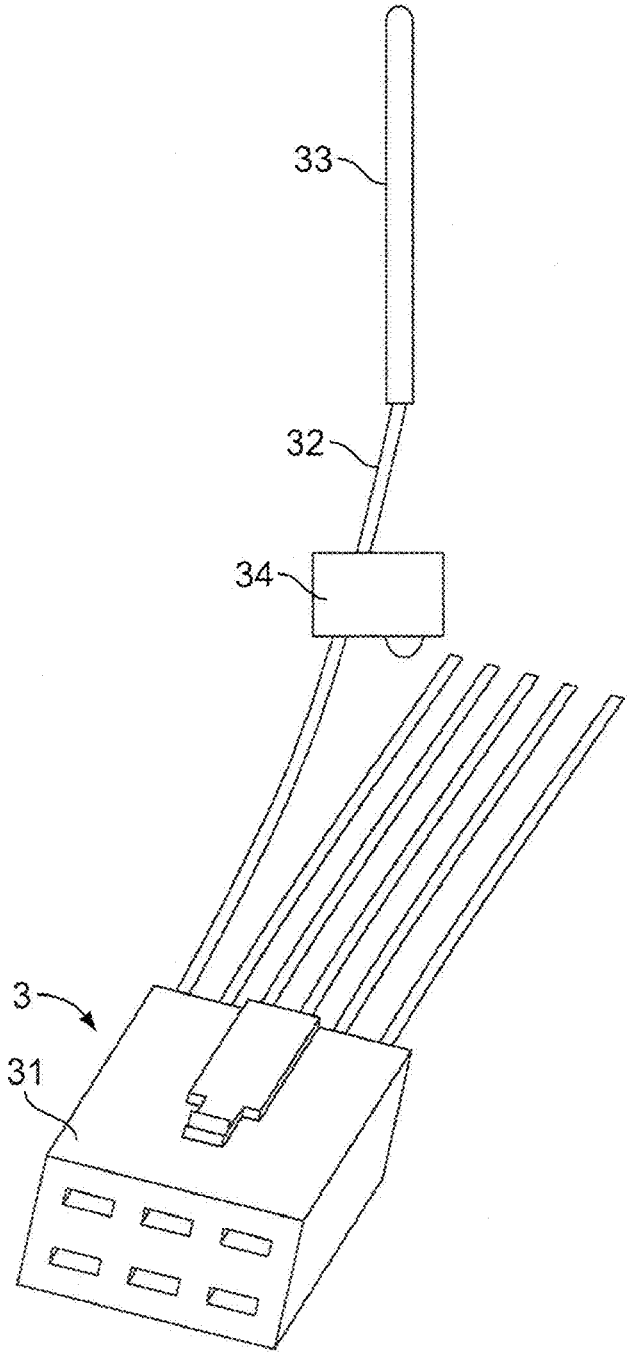
FIG. 3 is a diagram of the electrical connection.

FIGS. 1-3 show the utility of the invention with the controller comprising: a housing 1; inside the housing a circuit 2; with the housing having a top cover 11 and bottom plate 12. The circuit 2 has a circuit board 21 and adjustment device 22 with other electronic components. The circuit board 21 has a socket connector 23 and a wire harness connector 24. Top cover 11 has socket connector 23 aligned with socket connector opening 111. Top cover 11 also has wire harness connector 24 aligned to wire harness connector socket 115. Wire harness connector opening 115 has a bottom wall aligned with wire harness connector 24 and wire harness connector opening 112. The wire harness connector 24 has six protruding contacts disposed as flat metal members pointing upward and oriented parallel to each other. The wire harness connector 24 retains with the wire harness by means of a catch on the top cover 11. The catch is formed as an opening with a cross catch member which is disposed on the right side of the top cover 11. The catch can assist in retaining a hook of a plug of the wire harness.

This device does not need resin to secure the electronic components (and the two components on the circuit board) to the housing 1. This saves time and material to improve production. During testing if the electronic components have problem, one can take off the top cover and bottom plate and change only the internal components. This reduces waste and production cost. As a result, the housing is substantially hollow, that is only housing components rather than being filled with resin.

The top cover 11 aligns with the circuit board's 21 adjustment device 22 which is aligned with adjustment device window 113. The adjustment device window 113 has a water resistant elastomeric plug 114 which provides easy access to the adjustment device 22 while maintaining water resistance.

Additionally, the wire harness 3 and the wire harness connector opening 115 connect via wire harness plug 31. Wire harness plug 31 connects via connecting wire 32 to thermocouple 33. Thus, the wire harness 3 has a modular configuration for convenient exchange and maintenance.

For different car style there needs to be a different sensor type. Thus, the wire harness 3 can have connecting wire 32 connect to a small plug connector 34. Thus, the small plug connector 34 can be modularly attached to different sensor type having different thermocouple 33. If there is a problem, a thermocouple can also be modularly replaced or added to the wire harness connector.

Additionally, the bottom plate 4 can have mounting surface on both sides with mounting holes 41. The bottom plate 4 can connect to the top cover by aligned and secured by screws. The bottom plate is formed as a flat planar member. The top cover is substantially hollow forming a cavity for retaining components within.

At FIG. 4, the circuit board 21 shows a fan motor in series with a fuse and controlled by a relay. The relay is controlled by a thermistor circuit that is essentially a thermocouple. The thermocouple has a change in resistance proportional to change in temperature. At a set temperature, the thermocouple triggers the switching circuit of the adjustment device which controls the relay for controlling the fan. This is just one example of a switching circuit that is user adjustable for turning on the fan at different temperatures. The circuit can also be configured so that the fan operates proportionally to temperature, or has multiple stepped speeds based on multiple inputs of multiple thermocouples.

The fuse shown in the circuit is plugged into the socket connector opening 111 which leads to socket connector 23. The fuse preferably includes negative spike suppression.

The invention claimed is:

1. A car fan controller comprising:

a. a housing having a top cover and a bottom plate formed as a planar member;

b. a circuit disposed on a circuit board;

c. an adjustment device disposed on the circuit board;

d. a socket connector disposed on the circuit board, wherein the top cover has a socket connector opening aligned with the socket connector;

e. a wire harness connector disposed on the circuit board, wherein the top cover also has a wire harness connector aligned to a wire harness connector socket, and further comprising a wire harness connector opening having a bottom wall aligned with the wire harness connector and the wire harness connector opening; and f. a fan, controlled by the circuit disposed on the circuit board.

2. The car fan controller of claim 1, wherein the top cover aligns with an adjustment device of the circuit board which is aligned with an adjustment device window, wherein the adjustment device window has a water resistant elastomeric plug.

3. The car fan controller of claim 2, wherein, the wire harness and the wire harness connector opening connect via a wire harness plug; wherein the wire harness plug connects via connecting wire to a thermocouple.

4. The car fan controller of claim 3, wherein, the wire harness has connecting wire connected to a small plug connector.

5. The car fan controller of claim 4, wherein, the bottom plate can have mounting surface on both sides with mounting holes.

6. The car fan controller of claim 1, wherein, the wire harness and the wire harness connector opening connect via a wire harness plug; wherein the wire harness plug connects via connecting wire to a thermocouple.

7. The car fan controller of claim 6, wherein, the wire harness has connecting wire connected to a small plug connector.

8. The car fan controller of claim 7, wherein, the bottom plate can have mounting surface on both sides with mounting holes.

9. A car fan controller comprising:

a. a housing having a top cover and a bottom plate formed as a planar member, wherein the housing is substantially hollow forming a cavity for retaining components within;

b. a circuit disposed on a circuit board, wherein the circuit further comprises a relay for switching power on and off;

c. an adjustment device disposed on the circuit board;

d. a socket connector disposed on the circuit board, wherein the top cover has a socket connector opening aligned with the socket connector;

e. a wire harness connector disposed on the circuit board, wherein the top cover also has a wire harness connector aligned to a wire harness connector socket, and further comprising a wire harness connector opening having a bottom wall aligned with the wire harness connector and the wire harness connector opening; and f. a fan, controlled by the circuit disposed on the circuit board and switched on and off by the relay on the circuit.

10. The car fan controller of claim 9, wherein the top cover aligns with an adjustment device of the circuit board which is aligned with an adjustment device window, wherein the adjustment device window has a water resistant elastomeric plug.

11. The car fan controller of claim 10, wherein, the wire harness and the wire harness connector opening connect via a wire harness plug; wherein the wire harness plug connects via connecting wire to a thermocouple.

12. The car fan controller of claim 11, wherein, the wire harness has connecting wire connected to a small plug connector.

13. The car fan controller of claim 12, wherein, the bottom plate can have mounting surface on both sides with mounting holes.

14. The car fan controller of claim 9, wherein, the wire harness and the wire harness connector opening connect via a wire harness plug; wherein the wire harness plug connects via connecting wire to a thermocouple.

15. The car fan controller of claim 14, wherein, the wire harness has connecting wire connected to a small plug connector.

16. The car fan controller of claim 15, wherein, the bottom plate can have mounting surface on both sides with mounting holes.

* * * * *